US009395657B2

(12) United States Patent
Okumura

(10) Patent No.: US 9,395,657 B2
(45) Date of Patent: Jul. 19, 2016

(54) IMAGE FORMING APPARATUS AND DRIVE CONTROL OF IMAGE BEARING MEMBER MOTOR

(71) Applicant: CANON KABUSHIKI KAISHA, Tokyo (JP)

(72) Inventor: Yasuhiko Okumura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/732,526

(22) Filed: Jun. 5, 2015

(65) Prior Publication Data

US 2015/0362867 A1 Dec. 17, 2015

(30) Foreign Application Priority Data

Jun. 12, 2014 (JP) ..... 2014-121495

(51) Int. Cl.
*G03G 15/16* (2006.01)

(52) U.S. Cl.
CPC ..... *G03G 15/1615* (2013.01)

(58) Field of Classification Search
CPC ..... G03G 15/1615; G03G 15/0136; G03G 2215/0129; G03G 2215/0132; G03G 2215/00156; B65H 3/0669; B65H 2553/51
See application file for complete search history.

(56) References Cited

U.S. PATENT DOCUMENTS

2008/0159784 A1* 7/2008 Seto ..... G03G 15/5008 399/167
2010/0158551 A1* 6/2010 Shirakata ..... G03G 15/0131 399/66
2010/0183322 A1* 7/2010 Funamoto ..... G03G 15/5008 399/43
2010/0226676 A1* 9/2010 Funamoto ..... G03G 15/161 399/66
2011/0085827 A1* 4/2011 Tominaga ..... G03G 15/043 399/301
2012/0003010 A1* 1/2012 Birumachi ..... G03G 15/5004 399/167
2014/0119760 A1* 5/2014 Ju ..... G03G 15/1665 399/66
2014/0267526 A1* 9/2014 Doshida ..... G03G 15/5008 347/116

FOREIGN PATENT DOCUMENTS

JP 2006-243545 A 9/2006

* cited by examiner

*Primary Examiner* — Francis Gray
(74) *Attorney, Agent, or Firm* — Canon USA, Inc., IP Division

(57) ABSTRACT

A CPU for controlling a first motor for rotating and driving a photoconductive drum and a second motor for rotating and driving an intermediate transfer belt determines the rotation speed of the photoconductive drum at the time of image formation on the basis of information on a load torque of the second motor detected when the second motor is driven at a predetermined rotation speed and the rotation speed of the first motor is gradually changed in a state where no high voltage is applied to a primary transfer roller and information on a load torque of the second motor detected when the second motor is driven at a predetermined rotation speed and the rotation speed of the first motor is gradually changed in a state where a high voltage is applied to the primary transfer roller.

12 Claims, 6 Drawing Sheets

IMAGE FORMING APPARATUS AND DRIVE CONTROL OF IMAGE BEARING MEMBER MOTOR

BACKGROUND OF THE INVENTION

1. Field of the Invention

The present invention relates to an electrophotographic image forming apparatus such as a copier or a printer.

2. Description of the Related Art

Electrophotographic image forming apparatuses such as a copier and a printer form a toner image on an image bearing member such as a photoconductive drum or an intermediate transfer belt, transfer the toner image formed on the image bearing member to a recording medium, and then fix the toner image on the recording medium. In general, the photoconductive drum and the intermediate transfer belt are rotated or driven at a constant speed so as to prevent an image from extending and shortening. The accuracy of speeds of the photoconductive drum and the intermediate transfer belt affects the reproducibility of an image finally formed on the recording medium. Even image extension/shortening caused by minute unevenness in rotation speed appears on an image on the recording medium as uneven density called banding, which is responsible for image degradation.

Electrophotographic color image forming apparatuses of the tandem type become mainstream in which four photoconductive drums corresponding to four color components are provided in series in the rotation direction of an intermediate transfer belt and toner images formed on the photoconductive drums are superimposed at the time of being transferred to the intermediate transfer belt. In the case of the tandem type, the change in the speed of each photoconductive drum results in a deviation from a predetermined image forming position on the photoconductive drum and a deviation from a predetermined image transfer position on the intermediate transfer belt, and the change in the speed of the intermediate transfer belt results in the shift of the image transfer position from each photoconductive drum to the intermediate transfer belt. An image in which color images are individually deviated from their predetermined image transfer positions is formed on a recording medium, that is, so-called color misregistration appears on the recording material. This leads to image degradation.

A driving device for rotating a photoconductive drum or an intermediate transfer belt is subjected to phase-locked loop (PLL) control performed by a brushless DC motor so that a motor speed is constant. However, even when the motor speed is constant, the speed of the photoconductive drum and the speed of a driving roller for driving the intermediate transfer belt may be unstable owing to gear eccentricity. In an image forming apparatus achieving high image quality, instead of the constant speed control for a driving motor, a constant speed control method of providing a speed sensor such as an optical encoder for a driving roller for rotating a photoconductive drum or an intermediate transfer belt which is a load shaft and performing the feedback control of the speed of the load shaft is employed.

However, even when the constant speed control is performed for a load shaft using an encoder provided on the load shaft, the surface speed of a photoconductive drum does not necessarily reach a target speed owing to the tolerance of the diameter of the photoconductive drum. Similarly, even when the constant speed control is performed for a load shaft using an encoder provided on the load shaft (driving roller shaft), the surface speed of an intermediate transfer belt does not necessarily reach a target speed owing to the tolerance of the diameter of the driving roller and the tolerance of the thickness of the intermediate transfer belt. In addition, owing to the change in an ambient temperature, the outer shape of a driving roller for a photoconductive drum or an intermediate transfer belt is changed and the surface speed of the photoconductive drum or the intermediate transfer belt is changed from a desired value. As a result, a frictional force is increased, the extent of a speed variation of the photoconductive drum or the intermediate transfer belt is increased, and the degrees of color misregistration and banding are increased. Examples of a method of detecting a surface speed include a method of making marks at uniformly spaced positions on a photoconductive drum or an intermediate transfer member and measuring a pass time of the marks using an optical sensor and a method of detecting a surface speed using a Doppler velocimeter. These methods increase a cost.

A method of addressing such a problem is disclosed in, for example, Japanese Patent Laid-Open No. 2006-243545. That is, the rotation speed of an intermediate transfer belt is changed, a load applied to a photoconductive drum at that time is detected, and a diagram representing the relationship between the rotation speed of the intermediate transfer belt and the detected load applied to the photoconductive drum is made. At an inflection point in the diagram, it is determined that the rotation speeds of the photoconductive drum and the intermediate transfer belt are the same. At a target speed obtained by adding a predetermined circumferential speed difference to the speed at the inflection point, the intermediate transfer belt is driven.

In Japanese Patent Laid-Open No. 2006-243545, the state in which the rotation speeds of the photoconductive drum and the intermediate transfer belt are the same is determined from the inflection point in the diagram produced on the basis of the detected values. In order to determine the inflection point, a differentiation operation is performed. The operation of determining the inflection point is therefore greatly influenced by a detection error. An accurate result may not be obtained.

SUMMARY OF THE INVENTION

The present invention provides the following image forming apparatuses.

An image forming apparatus includes an image bearing member configured to carry a toner image, a belt member which is in contact with the image bearing member, wherein the toner image from the image bearing member is transferred to the belt member, a first driving source configured to drive the image bearing member, a first detection member configured to detect a rotation speed of the image bearing member, a rotary member configured to apply a driving force to the belt member, a second driving source configured to drive the rotary member, a second detection member configured to detect a rotation speed of the rotary member, a transfer member that is in contact with the image bearing member across the belt member, a power supply configured to apply a voltage to the transfer member, a control unit configured to control the first driving source on the basis of a detection result of the first detection member and control the second driving source on the basis of a detection result of the second detection member, a switching unit configured to switch between a first state and a second state, no voltage being applied from the power supply to the transfer member in the first state, a voltage being applied from the power supply to the transfer member in the second state, an acquisition unit configured to acquire information on a load torque applied to the second driving source when the second driving source drives the rotary member at a predetermined rotation speed, and an execution unit configured to execute an image formation with a rotation speed of the image bearing member based on a first relationship and a second relationship. The first relationship is a relationship between each of a plurality of different rotation speeds with which the image bearing member is driven in the first state and the corresponding information acquired by the acquisition unit. The second relationship is a relationship between each of a plurality of different rotation speeds with which the image bearing member is driven in the second state and the corresponding information acquired by the acquisition unit.

An image forming apparatus includes an image bearing member configured to carry a toner image, a belt member which is in contact with the image bearing member, wherein the toner image from the image bearing member is transferred to the belt member, a first driving source configured to drive the image bearing member, a first detection member configured to detect a rotation speed of the image bearing member, a rotary member configured to apply a driving force to the belt member, a second driving source configured to drive the rotary member, a second detection member configured to detect a rotation speed of the rotary member, a transfer member that is in contact with the image bearing member across the belt member, a power supply configured to apply a voltage to the transfer member, a control unit configured to control the first driving source on the basis of a detection result of the first detection member and control the second driving source on the basis of a detection result of the second detection member, a switching unit configured to switch between a first state and a second state, no voltage being applied from the power supply to the transfer member in the first state, a voltage being applied from the power supply to the transfer member in the second state, an acquisition unit configured to acquire information on a load torque applied to the first driving source when the first driving source drives the image bearing member at a predetermined rotation speed, and an execution unit configured to execute an image formation with a rotation speed of the rotary member based on a third relationship and a fourth relationship. The third relationship is a relationship between each of a plurality of different rotation speeds with which the rotary member is driven in the first state and the corresponding information acquired by the acquisition unit. The fourth relationship is a relationship between each of a plurality of different rotation speeds with which the rotary member is driven in the second state and the corresponding information acquired by the acquisition unit.

Further features of the present invention will become apparent from the following description of exemplary embodiments with reference to the attached drawings.

DESCRIPTION OF THE EMBODIMENTS

Embodiments of the present invention will be described in detail below with reference to the accompanying drawings.

First Embodiment

<Configuration of Image Forming Apparatus>

Figure 1A:
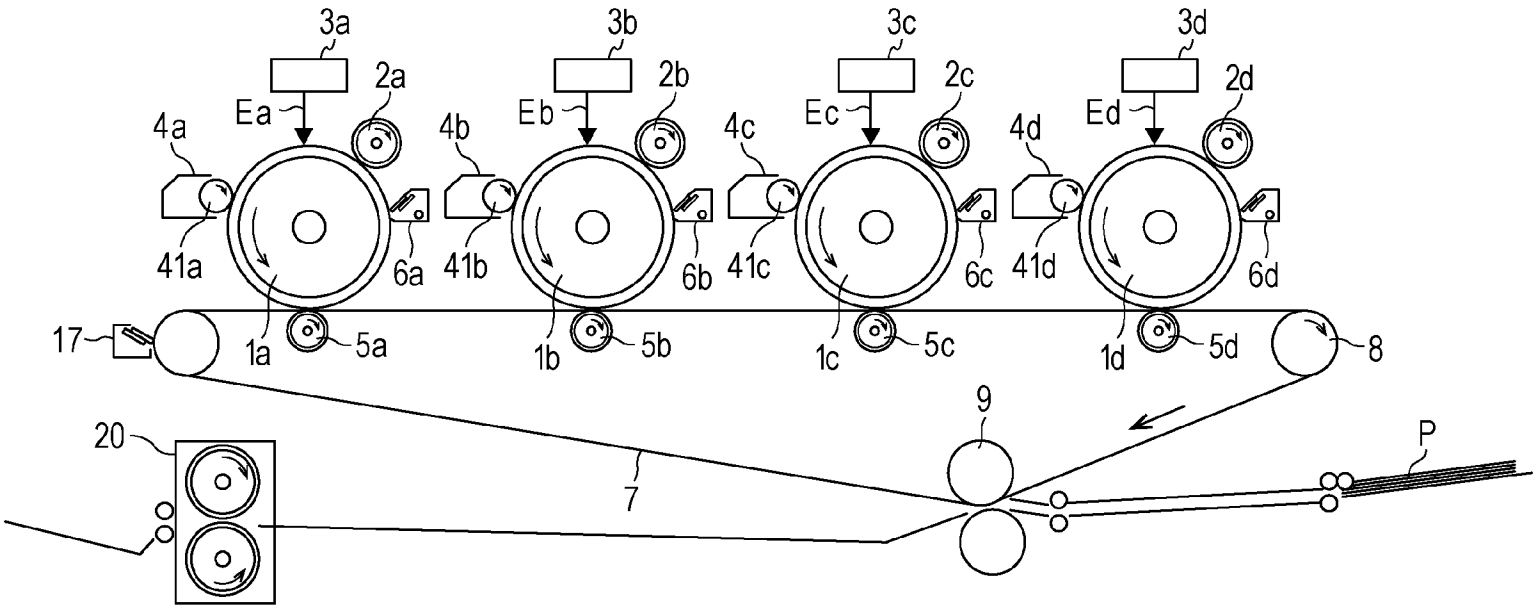
FIG. 1A is a schematic diagram illustrating the configurations of an image forming apparatus according to first and second embodiments of the present invention.

FIG. 1A is a schematic diagram illustrating the configuration of an electrophotographic image forming apparatus according to the first embodiment. The image forming apparatus includes four image forming stations for yellow, magenta, cyan, and black. Referring to FIG. 1A, suffixes a, b, c, and d attached to reference numerals correspond to image forming stations for yellow, magenta, cyan, and black, respectively. These image forming stations have the same configuration. It is noted that the suffixes a to d are omitted in the following description except in a case where a member in a specific image forming station is described.

Referring to FIG. 1A, a CPU 100 to be described later (see FIG. 1B) performs overall control of an image forming apparatus. Upon receiving an instruction for forming an image on a recording medium P, the CPU 100 controls pre-rotation for an image forming operation. A photoconductive drum 1 that is an image bearing member, a driving roller 8 for rotating and driving an intermediate transfer belt 7 that is a belt member, a charging roller 2, a developing sleeve 41, a primary transfer roller 5, a secondary transfer roller 9, and each roller in a fixing device 20 start to rotate in a direction represented by an arrow in the drawing. A high voltage power supply (not illustrated) is connected to the charging roller 2. A high voltage obtained by superimposing an AC voltage on a DC voltage is applied from the high voltage power supply to the charging roller 2. The surface of the photoconductive drum 1 that is in contact with the charging roller 2 is therefore uniformly charged to the same potential as that of a DC voltage applied from the high voltage power supply. When the charged surface of the photoconductive drum 1 rotates and reaches a position of laser irradiated from the exposure device 3, the exposure device 3 performs exposure in accordance with an image signal and an electrostatic latent image is formed on the photoconductive drum 1. Subsequently, in a developing device 4, a high voltage obtained by superimposing an AC voltage on a DC voltage is applied from a high voltage power supply (not illustrated) to a developing sleeve 41. The electrostatic latent image is therefore developed with toner on the developing sleeve 41 and is generated as a visible image (toner image). The photoconductive drum 1 rotates toward the primary transfer roller 5 that is a transfer member.

Toner images formed on photoconductive drums 1*a* to 1*d* in the respective image forming stations are transferred to the intermediate transfer belt 7 in a contact portion in which the photoconductive drums 1*a* to 1*d* are in contact with the intermediate transfer belt 7 in an overlapped manner by the primary transfer roller 5. The toner image transferred from the photoconductive drum 1 to the intermediate transfer belt 7 is then transferred to the recording medium P by the secondary transfer roller 9. At the time of transfer of a toner image from the photoconductive drum 1 to the intermediate transfer belt 7, a DC high voltage is applied from a high voltage power supply 51 (see FIG. 2) to the primary transfer roller 5. Similarly, at the time of transfer of a toner image from the intermediate transfer belt 7 to the recording medium P, a DC high voltage is applied from a high voltage power supply (not illustrated) to the secondary transfer roller 9. Toner that is not transferred to the intermediate transfer belt 7 and remains on the photoconductive drum 1 is scraped by a photoconductive drum cleaner 6 and is collected. Similarly, toner that is not transferred to the recording medium P and remains on the intermediate transfer belt 7 is scraped by an intermediate transfer belt cleaner 17 and is collected. The toner image transferred to the recording medium P is exposed to pressure and heat from the fixing device 20 and is fixed to the recording medium P.

<Configuration of Intermediate Transfer Belt Driving Unit>

Figure 1B:
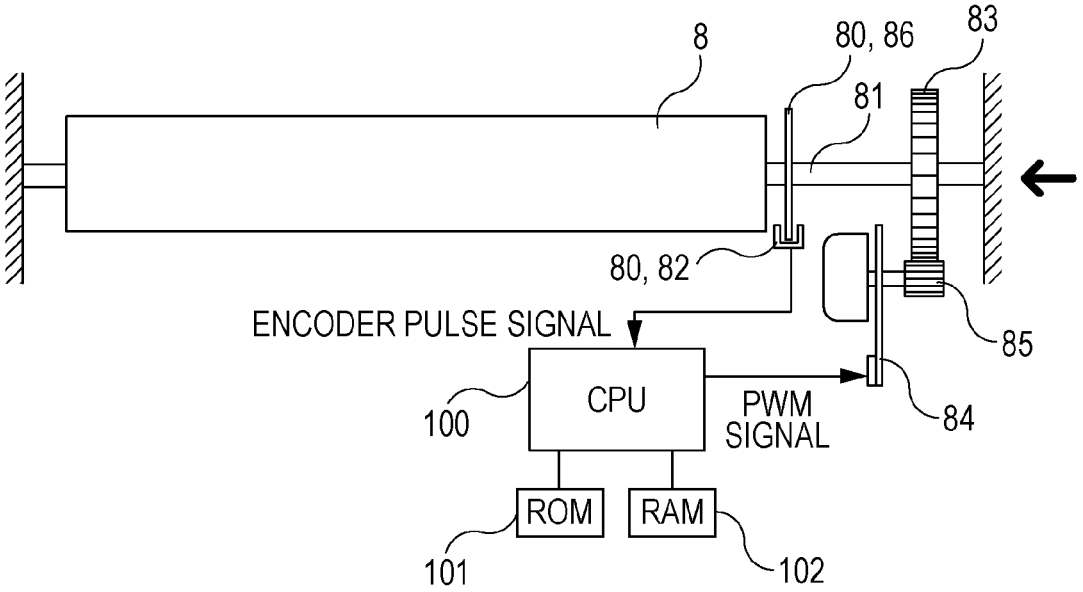
FIG. 1B is a schematic diagram of an intermediate transfer belt driving unit according to the first and second embodiments.

FIG. 1B is a schematic diagram illustrating the configurations of a driving unit for the driving roller 8 for driving the intermediate transfer belt 7 and a control unit for controlling the driving unit. FIG. 1B is a diagram illustrating the driving roller 8 as viewed from the side surface (right-hand or left-hand side) of FIG. 1A. Referring to FIG. 1B, the CPU 100 that is a control unit controls a brushless DC motor 84 (hereinafter merely referred to as the motor 84). The motor 84 that is a second driving source drives the driving roller 8 that is a rotary member under the control of the CPU 100. The driving roller 8 is a cylindrical rotary member that rotates while being held by a rotation shaft 81. When the driving roller 8 rotates, the intermediate transfer belt 7 rotates in synchronization with the rotation of the driving roller 8. A driving roller gear 83 for transferring a driving force from a disc 86 and the motor 84 is fixed to the rotation shaft 81. The rotation of the motor 84 is transferred to the driving roller gear 83 via the motor gear 85, so that the driving roller 8 is driven and the intermediate transfer belt 7 rotates.

The disc 86 is a transparent resin rotary member that transmits light and rotates in synchronization with the driving roller 8. Referring to FIG. 1B, on the surface of the disc 86 facing the driving roller 8, a plurality of marks (optical marks) (not illustrated) that block light are spaced uniformly. An optical encoder 80 (hereinafter merely referred to as the encoder 80) that is a second detection member includes the disc 86 and a photosensor 82 including a light emitting unit and a light receiving unit as illustrated in FIG. 1B, and detects the optical marks on the disc 86 that rotates in synchronization with the driving roller 8. When a part of the surface of the disc 86 including no optical mark passes through the photosensor 82, light emitted from the light emitting unit in the photosensor 82 is detected by the light receiving unit. On the other hand, a part of the surface of the disc 86 including an optical mark passes through the photosensor 82, light emitted from the light emitting unit in the photosensor 82 is blocked by the optical mark and is not detected by the light receiving unit. At that time, the encoder 80 (the photosensor 82) outputs an encoder pulse signal to the CPU 100. The CPU 100 calculates the rotation speed of the driving roller 8 on the basis of an output interval of an encoder pulse signal output from the encoder 80, performs feedback control computation so that the motor 84 rotates at a predetermined rotation speed, and outputs a PWM signal that is a driving instruction to the motor 84. Thus, the CPU 100 does not perform constant speed control for the motor 84, and performs feedback control of the rotation speed of the driving roller 8 that is a load shaft so that the intermediate transfer belt 7 rotates at a constant speed. The CPU 100 includes a Read-Only Memory (ROM) 101 and a Random Access Memory (RAM) 102 that are storage units. The ROM 101 stores a control program to be executed by the CPU 100 and data. The RAM 102 is a memory in which information is temporarily stored during the execution of a control program performed by the CPU 100. In addition, the CPU 100 has a timer function of measuring a time.

<Configurations of Driving Unit for Photoconductive Drum and Primary Transfer Unit>

Figure 2:
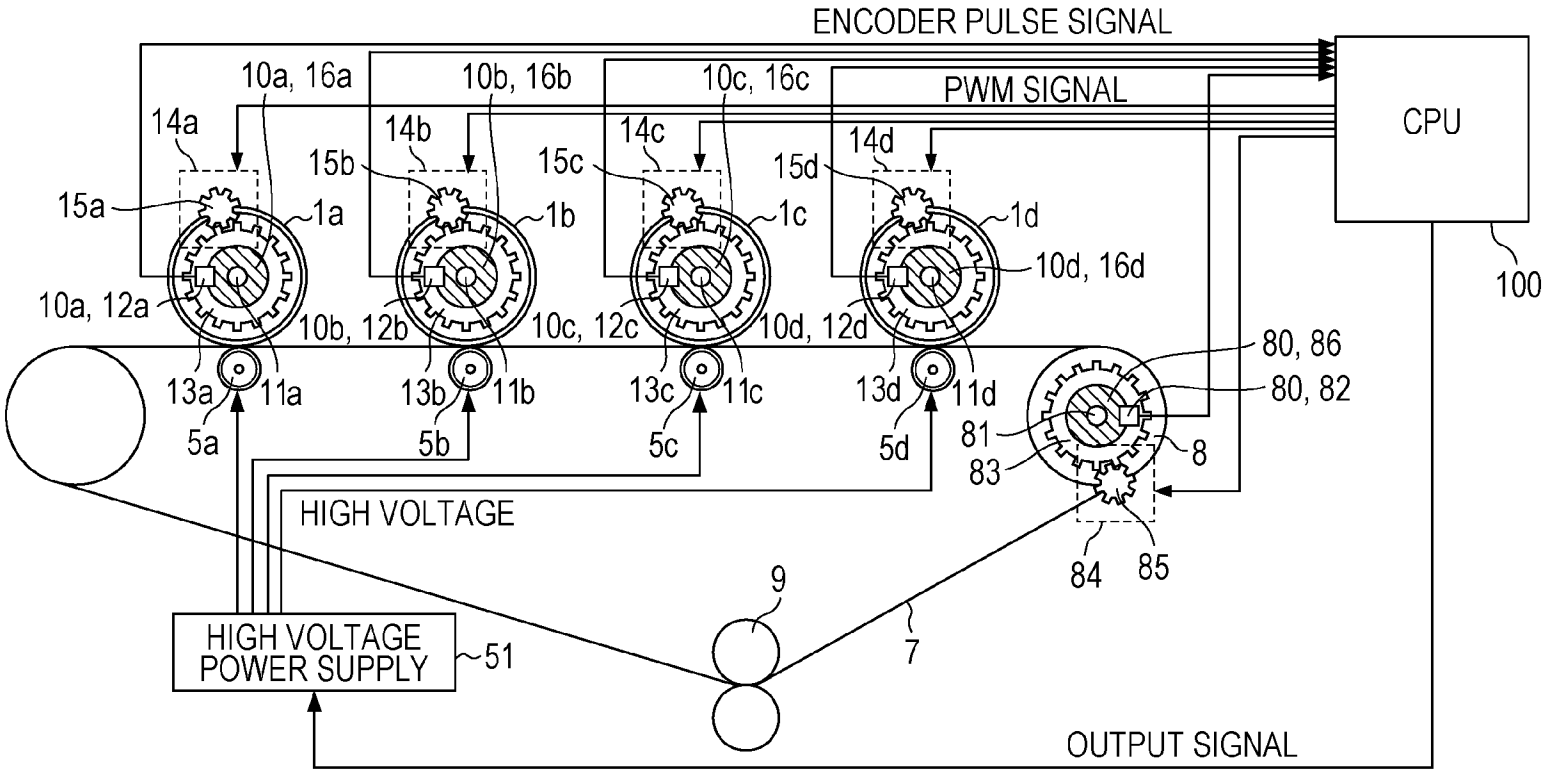
FIG. 2 is a diagram illustrating the configurations of a photoconductive drum driving unit, the intermediate transfer belt driving unit, and a primary transfer unit according to the first and second embodiments.

FIG. 2 is a schematic diagram illustrating the configurations of a driving unit for the photoconductive drum 1, a driving unit for the intermediate transfer belt 7, the primary transfer roller 5, high voltage power supply 51, and the CPU 100 for controlling these components. FIG. 2 is used to describe the control of rotation of the photoconductive drum 1 and the intermediate transfer belt 7 in the image forming apparatus illustrated in FIG. 1A, and the illustration of, for example, the charging roller 2, the exposure device 3, and the developing device 4 in each image forming station is omitted. In FIG. 2, the driving roller 8 for rotating and driving the intermediate transfer belt 7 and the motor 84 described with reference to FIG. 1B are illustrated as viewed from the side surface of FIG. 1B (a direction represented by an arrow in FIG. 1B). The control of the motor 84 (a portion enclosed by a broken line in FIG. 2) has already been described with reference to FIG. 1B, and the description thereof will be therefore omitted.

For the photoconductive drum 1 in each image forming station, a driving unit is provided which has a configuration similar to that of the driving unit for the intermediate transfer belt 7 described with reference to FIG. 1B. Driving units for respective image forming stations have the same configuration. The CPU 100 controls a brushless DC motor 14 (hereinafter merely referred to as the motor 14) that is a portion enclosed by a broken line in FIG. 2. The motor 14 that is a first driving source drives the photoconductive drum 1 that is a rotary member under the control of the CPU 100. The photoconductive drum 1 is a cylindrical rotary member that rotates while being held by a rotation shaft 11. A drum gear 13 for transferring a driving force from a disc 16 that is a hatched portion and the motor 14 is fixed to the rotation shaft 11. The rotation of the motor 14 is transferred to the drum gear 13 via a motor gear 15, so that the photoconductive drum 1 is driven.

The disc 16 is a transparent resin rotary member that transmits light like the disc 86 and rotates in synchronization with the photoconductive drum 1. On the surface of the disc 16, a plurality of marks (optical marks) (not illustrated) that block light are made. An optical encoder 10 (hereinafter merely referred to as the encoder 10) that is a first detection member includes the disc 16 and a photosensor 12 including a light emitting unit and a light receiving unit like the encoder 80. The encoder 10 (the photosensor 12) detects the optical marks on the encoder 10 (the disc 16) that rotates in synchronization with the photoconductive drum 1. The photosensor 12 outputs an encoder pulse signal that is a speed signal each time the photoconductive drum 1 rotates and the edge of the optical mark on the disc 16 passes therethrough. The output encoder pulse signal is input into the CPU 100. The CPU 100 calculates the rotation speed of the photoconductive drum 1 on the basis of the received encoder pulse signal, performs feedback control computation so that the motor 14 rotates at a predetermined rotation speed, and outputs a PWM signal that is a driving instruction to the motor 14. Thus, the CPU 100 performs control processing so that the photoconductive drum 1 in each image forming station rotates at a constant speed.

The discs 16 and 86 according to this embodiment are transparent resin rotary members that transmit light, and a plurality of marks (optical marks) (not illustrated) that block light are made on the surface of each of the discs 16 and 86. However, another configuration may be employed. For example, these discs may be metal discs and slits may be provided in each of the discs instead of the optical marks. In this case, the light receiving unit in the encoder detects light that has been emitted from the light emitting unit and passed through the slit. A part of the disc including no slit may block light emitted from the light emitting unit.

A high voltage power supply 51 that is a voltage application unit is connected to the primary transfer roller 5 facing the photoconductive drum 1 across the intermediate transfer belt 7. The high voltage power supply 51 applies a positive high voltage to the primary transfer roller 5 so as to transfer a negatively charged toner image from the photoconductive drum 1 to the intermediate transfer belt 7. The CPU 100 outputs a signal representing an instruction for applying a high voltage to the primary transfer roller 5 to the high voltage power supply 51. The high voltage power supply 51 applies a positive high voltage to the primary transfer roller 5 in response to the signal output from the CPU 100.

<Control Sequence for Calculation of Surface Speeds of Photoconductive Drum and Intermediate Transfer Belt>

Figure 4:
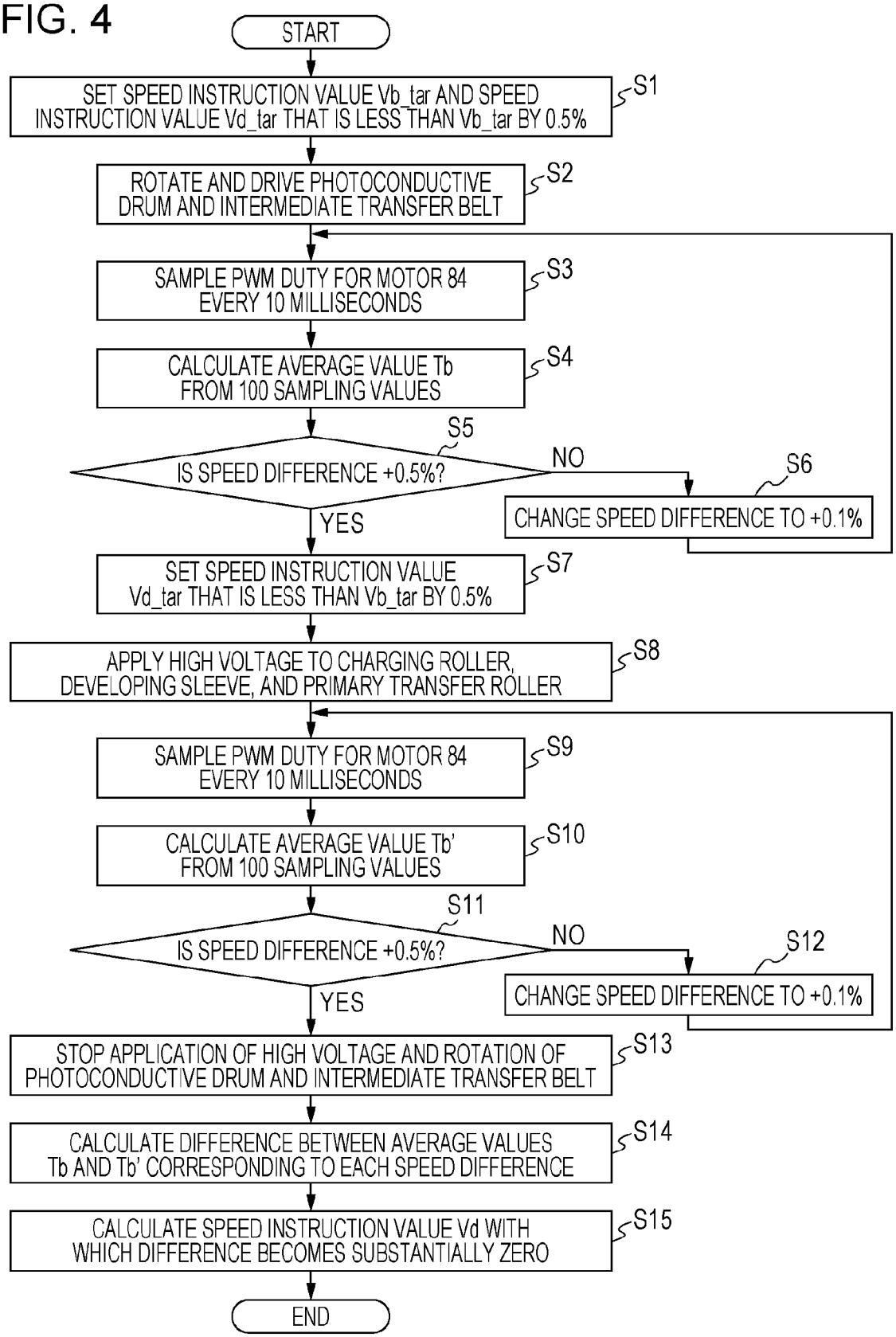
FIG. 4 is a flowchart illustrating a process of calculating a speed instruction value for a photoconductive drum according to the first embodiment.

FIG. 4 is a flowchart illustrating a control sequence for the calculation of a speed instruction value for the photoconductive drum 1 with which the surface speeds of the photoconductive drum 1 and the intermediate transfer belt 7 in an image forming apparatus are the same. The flowchart in FIG. 4 shows an operational sequence in an adjustment mode in which the speeds of the photoconductive drum 1 and the intermediate transfer belt 7 according to this embodiment are adjusted. The adjustment mode illustrated in FIG. 4 is started when the replacement of the photoconductive drum 1 or the intermediate transfer belt 7 is detected or when a maintenance staff for the image forming apparatus makes an adjustment instruction, and is executed by the CPU 100.

The image forming apparatus has two operational modes, a color mode in which color printing is performed and a monochrome mode in which black-and-white printing is performed. In the color mode, the intermediate transfer belt 7 is in contact with the photoconductive drums 1*a* to 1*d* in the respective image forming stations. On the other hand, in the monochrome mode, the intermediate transfer belt 7 is in contact with the photoconductive drum 1*d* in a black image forming station and is separated from the photoconductive drums 1*a* to 1*c*. The control sequence illustrated in FIG. 4 is started when the operational mode is the color mode. For the motors 14 corresponding to the photoconductive drums 1 in all image forming stations, the control process illustrated in FIG. 4 is performed. That is, the CPU 100 performs the control process so that the discs 16*a*, 16*b*, 16*c*, and 16*d* in the image forming stations rotate at the same rotation speed.

In step S1, the CPU 100 sets a speed instruction value for the intermediate transfer belt 7 to a fixed value Vb_tar, and sets a speed instruction value Vd_tar for the photoconductive drum 1 to an initial value that is less (slower) than the speed instruction value Vb_tar for the intermediate transfer belt 7 by 0.5%.

For expression of units of the speed instruction value Vd_tar for the photoconductive drum 1 and the speed instruction value Vb_tar for the intermediate transfer belt 7, the angular speeds (rad/s) of the encoders 10 and 80 are used in calculation performed by the CPU 100. However, in this embodiment, in order to unify speed units, a surface speed converted value (mm/s) is used which is acquired with the diameter of the photoconductive drum 1 and a nominal value obtained by adding the thickness of the intermediate transfer belt 7 to the diameter of the driving roller 8 for the intermediate transfer belt 7. It should be noted that the speed instruction value Vd_tar for the photoconductive drum 1 and the speed instruction value Vb_tar for the intermediate transfer belt 7 indicate the target rotation speeds of the discs 16 and 86, respectively, and do not indicate the target surface speeds of the photoconductive drum 1 and the intermediate transfer belt 7, respectively.

As described previously, a speed instruction value that is less than the speed instruction value Vb_tar by 0.5% is calculated. For example, when the speed instruction value Vb_tar for the intermediate transfer belt 7 is 350 mm/s, the speed instruction value Vd_tar for the photoconductive drum 1 is 348.25 mm/s (=350 mm/s×(100%−0.5%)).

In step S2, the CPU 100 outputs, to the motor 84 for driving the intermediate transfer belt 7 via the driving roller 8, a PWM signal with which the speed of the intermediate transfer belt 7 becomes the speed instruction value Vb_tar so as to rotate and drive the motor 84. In addition, the CPU 100 outputs, to the motor 14 for driving the photoconductive drum 1, a PWM signal with which the speed of the photoconductive drum 1 becomes the speed instruction value Vd_tar so as to rotate and drive the motor 14.

In order to determine whether the speed of the photoconductive drum 1 is equal to the speed instruction value Vd_tar, the CPU 100 calculates the rotation speed of the disc 16 on the basis of an encoder pulse signal output from the encoder 10. The disc 16 is attached to the rotation shaft 11 to which the photoconductive drum 1 is also attached and rotates in synchronization with the photoconductive drum 1. The calculation of the rotation speed of the disc 16 is therefore equivalent to the calculation of the rotation speed of the photoconductive drum 1. On the basis of a result of the comparison between the calculated rotation speed of the disc 16 and the speed instruction value Vd_tar, the CPU 100 outputs to the motor 14 a PWM signal corresponding to a duty value (duty) with which the rotation speed of the photoconductive drum 1 is equal to the speed instruction value Vd_tar. The CPU 100 always performs the above-described feedback control in the control sequence in FIG. 4 upon the motors 14 in all image forming stations.

The CPU 100 performs upon the intermediate transfer belt 7 control processing similar to that performed upon the photoconductive drum 1. On the basis of an encoder pulse signal output from the encoder 80, the CPU 100 calculates the rotation speed of the disc 86 that is attached to the rotation shaft 81 and rotates in synchronization with the driving roller 8 for driving the intermediate transfer belt 7, that is, the rotation speed of the intermediate transfer belt 7. On the basis of a result of comparison between the calculated rotation speed of the disc 86 and the speed instruction value Vb_tar for the intermediate transfer belt 7, the CPU 100 outputs to the motor 84 a PWM signal corresponding to a duty value with which the rotation speed of the intermediate transfer belt 7 is equal to the speed instruction value Vb_tar. The CPU 100 always performs the above-described feedback control upon the motor 84 in the control sequence illustrated in FIG. 4.

Thus, the CPU 100 performs the above-described feedback control upon the motor 14 for driving the photoconductive drum 1 using the speed instruction value Vd_tar, so that the photoconductive drum 1 rotates at a constant speed. In step S3, the CPU 100 starts a timer after resetting the timer, reads a timer value, and performs the following processing every 10 milliseconds (ms). That is, the CPU 100 acquires a duty value corresponding to a PWM signal to be output to the motor 84 with which the speed of the photoconductive drum 1 is equal to the speed instruction value Vd_tar. This speed instruction value Vd_tar is set in step S1 or S6. Referring to FIG. 4, a duty value corresponding to a PWM signal is represented as a PWM duty. A sampling value may be stored in the RAM 102 at the time of the acquisition of the sampling value. Alternatively, acquired sampling values may be added and a sum of them may be stored in the CPU 100. In step S4, the CPU 100 calculates an average value Tb of duty values acquired in 100 sampling operations per second (=one second (=1,000 milliseconds)/10 milliseconds), associates the average value Tb with the speed instruction value Vd_tar for the photoconductive drum 1, and stores them in the RAM 102. Examples of a method of calculating the average value Tb representing the load torque characteristic of the motor 84 include a method of sequentially adding the sampling values acquired in step S3 and dividing a sum of the sampling values by 100 at the time of acquisition of 100 sampling values. In steps S3 and S4, the charging roller 2, the developing sleeve 41, and the primary transfer roller 5 in each image forming station are in a first state in which a high voltage is not applied to them, and the exposure of the exposure device 3 and the rotation and driving of the developing sleeve 41 are stopped.

In step S5, the CPU 100 determines whether the speed instruction value Vd_tar for the photoconductive drum 1 is greater (faster) than the target speed value Vb_tar of the intermediate transfer belt 7 by 0.5%. More specifically, the CPU 100 determines whether the speed instruction value Vd_tar has reached 351.75 mm/s (=350 mm/s×(100%+0.5%)) that is a speed instruction value greater than the target speed value Vb_tar by 0.5%. When the CPU 100 determines that the speed instruction value Vd_tar is 351.75 mm/s, the process proceeds to step S7. When the CPU 100 determines that the speed instruction value Vd_tar is less than 351.75 mm/s, the CPU 100 determines that the speed difference between them has not yet reached +0.5% and the process proceeds to step S6.

In step S6, the CPU 100 gradually changes the speed instruction value Vd_tar for the photoconductive drum 1 by +0.1%, that is, changes the current speed instruction value Vd_tar for the photoconductive drum 1 to a speed instruction value representing a speed faster than the speed instruction value Vb_tar for the intermediate transfer belt 7 by 0.1%. It is assumed that the current speed instruction value Vd_tar for the photoconductive drum 1 is a speed instruction value less than the speed instruction value Vb_tar by 0.5%. The CPU 100 changes the speed instruction value Vd_tar for the photoconductive drum 1 to a value less than the speed instruction value Vb_tar for the intermediate transfer belt 7 by 0.4% (=−0.5%+0.1%). That is, when the target speed value Vb_tar of the intermediate transfer belt 7 is 350 mm/s, the target speed value Vd_tar of the photoconductive drum 1 is 348.6 mm/s (=350 mm/s×(100%−0.4%)). In order to cause the CPU 100 to sample a duty value corresponding to a PWM signal to be output to the motor 84 with which the speed of the photoconductive drum 1 is equal to the changed speed instruction value Vd_tar, the process returns to step S3.

In step S7, the CPU 100 sets the speed instruction value for the intermediate transfer belt 7 to the fixed value Vb_tar again, and sets the speed instruction value Vd_tar for the photoconductive drum 1 to a speed instruction value less than the speed instruction value Vb_tar for the intermediate transfer belt 7 by 0.5% as an initial value. The CPU 100 outputs to the motor 84 for driving the intermediate transfer belt 7 via the driving roller 8 a PWM signal with which the speed of the intermediate transfer belt 7 becomes the speed instruction value Vb_tar and rotates and drives the motor 84. In addition, the CPU 100 outputs to the motor 14 for driving the photoconductive drum 1 a PWM signal with which the speed of the photoconductive drum 1 becomes the speed instruction value Vd_tar and rotates and drives the motor 14.

In step S8, the CPU 100 performs control processing so that a high voltage is applied to the charging roller 2, the developing sleeve 41, and the primary transfer roller 5 in each image forming station. That is, the CPU 100 applies a high voltage obtained by superimposing an AC voltage on a DC voltage from a high voltage power supply (not illustrated) to the charging roller 2 and charges the photoconductive drum 1. When a charge region on the photoconductive drum 1 reaches the developing sleeve 41, the CPU 100 applies a DC voltage from a high voltage power supply (not illustrated) to the developing sleeve 41. Although the high voltage power supply for development (not illustrated) can apply an AC voltage, the exposure device 3 does not perform the formation of an electrostatic latent image and toner development in the control sequence illustrated in FIG. 4. Accordingly, the application of an AC voltage is not performed and the developing sleeve 41 is not rotated and driven. By applying a DC voltage to the developing sleeve 41 in accordance with the charge potential of the photoconductive drum 1, toner and a carrier in the developing device 4 which are used for a toner frictional charge can be prevented from adhering to the photoconductive drum 1.

In addition, when the charge region on the photoconductive drum 1 reaches a primary transfer unit, the CPU 100 outputs to the high voltage power supply 51 a signal used for the application of a high voltage to the primary transfer roller 5 and the high voltage power supply 51 applies a DC voltage to the primary transfer roller 5 (second state). The value of the DC voltage applied from the high voltage power supply 51 to the primary transfer roller 5 is the value of a voltage applied to the primary transfer roller 5 at the time of usual image formation. An experiment has showed that a frictional force between the photoconductive drum 1 and the intermediate transfer belt 7 increases when a DC voltage is applied to the primary transfer roller 5. The reason why the photoconductive drum 1 is charted by the charging roller 2 is that, when a primary transfer voltage is applied to the primary transfer roller 5 in a state where the photoconductive drum 1 is not charged, an unexpected potential memory remains in the photoconductive drum 1.

In step S9, like in step S3, the CPU 100 starts a timer after resetting the timer and reads a timer value. The CPU 100 acquires a duty value corresponding to a PWM signal to be output to the motor 84 with which the speed of the photoconductive drum 1 is equal to the speed instruction value Vd_tar set in step S7 or S12 to be described later every 10 milliseconds (ms). In step S10, like in step S4, the CPU 100 calculates an average value Tb' of duty values acquired in 100 sampling operations per second, associates the average value Tb' with the speed instruction value Vd_tar for the photoconductive drum 1, and stores them in the RAM 102. In step S11, the CPU 100 determines whether the speed instruction value Vd_tar for the photoconductive drum 1 has reached 351.75 mm/s (=350 mm/s×(100%+0.5%)) that is a speed instruction value greater than the target speed value Vb_tar of the intermediate transfer belt 7 by 0.5%. When the CPU 100 determines that the speed instruction value Vd_tar for the photoconductive drum 1 has reached 351.75 mm/s, the CPU 100 determines that the sampling of a duty value corresponding to a PWM signal for the motor 84 has completed through the process from steps S9 to S10 and the process proceeds to step S13. On the other hand, when the CPU 100 determines that the speed instruction value Vd_tar for the photoconductive drum 1 has not reached 351.75 mm/s, the process proceeds to step S12. In step S12, like in step S6, the CPU 100 changes the current speed instruction value Vd_tar for the photoconductive drum 1 to a speed instruction value representing a speed faster than the speed instruction value Vb_tar for the intermediate transfer belt 7 by 0.1%. The process returns to step S9.

In step S13, in order to sequentially stop the application of a high voltage to the charging roller 2, the developing sleeve 41, and the primary transfer roller 5, the CPU 100 stops the output of a signal to a high voltage power supply (not illustrated) and the high voltage power supply 51. In addition, in order to stop the rotation and driving of the motor 14 for rotating and driving the photoconductive drum 1 and the motor 84 for rotating and driving the intermediate transfer belt 7 via the driving roller 8, the CPU 100 stops the output of a PWM signal.

Figure 3:
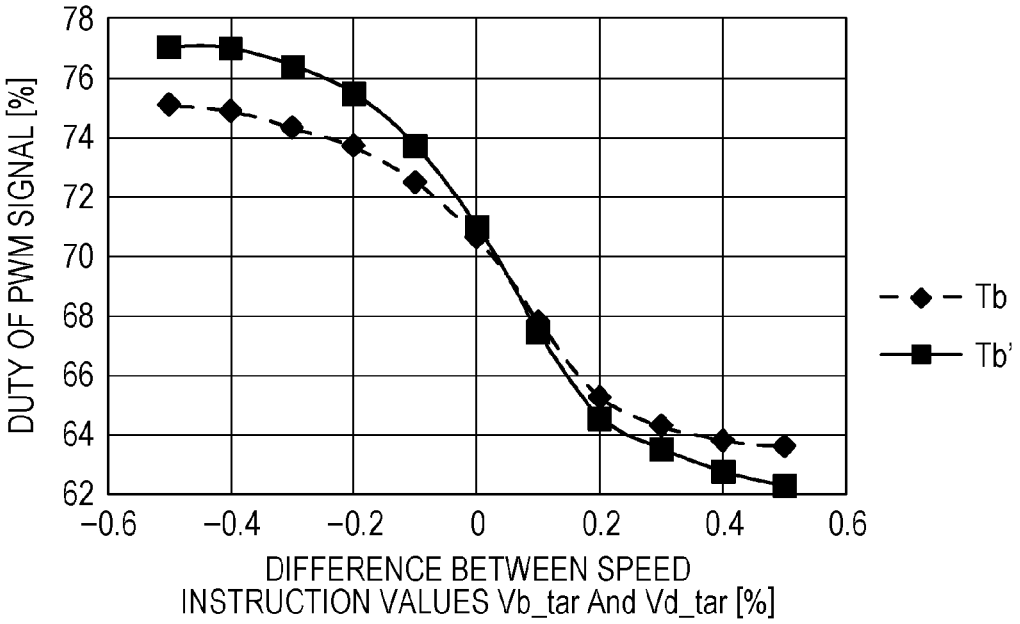
FIG. 3 is a diagram illustrating the duty characteristics of a PWM signal corresponding to the difference between speed instruction values.

In a graph illustrated in FIG. 3, the average values Tb and Tb' of duty values corresponding to PWM signals for the motor 84 which have been calculated in steps S4 and S10 are plotted. Referring to FIG. 3, there are provided a broken line obtained by plotting the average values Tb acquired when a high-voltage is not applied to the primary transfer roller 5 and a solid line obtained by plotting the average values Tb' acquired when a high-voltage is applied to the primary transfer roller 5. A vertical axis in FIG. 3 represents a duty (%) of a PWM signal which is the magnitude of a duty value corresponding to a PWM signal for the motor 84. The duty value is also a parameter related to a load torque applied to the motor 84. A horizontal axis in FIG. 3 represents the difference (%) between the speed instruction value Vd_tar for the photoconductive drum 1 and the speed instruction value Vb_tar for the intermediate transfer belt 7, and a numerical value in the horizontal axis indicates a result of the computation of [(Vd_tar−Vb_tar)/Vb_tar]×100.

As illustrated in FIG. 3, as the speed instruction value Vd_tar for the photoconductive drum 1 increases, the state in which the intermediate transfer belt 7 drags the photoconductive drum 1 is changed to the state in which the photoconductive drum 1 drags the intermediate transfer belt 7 owing to a circumferential speed difference between the intermediate transfer belt 7 and the photoconductive drum 1. That is, when the speed instruction value Vd_tar for the photoconductive drum 1 increases, a duty value decreases and a load torque applied to the motor 84 for driving the intermediate transfer belt 7 via the driving roller 8 is reduced as is apparent from the graph in FIG. 3. At the time of the calculation of the average value Tb', since a high voltage is applied to the primary transfer roller 5, the frictional force between the photoconductive drum 1 and the intermediate transfer belt 7 is increased. On the other hand, at the time of the calculation of the average value Tb, since a high voltage is not applied to the primary transfer roller 5, the frictional force between the photoconductive drum 1 and the intermediate transfer belt 7 is smaller than that obtained at the time of the calculation of the average value Tb'. Accordingly, when the difference between the speed instruction value for the motor 14 and the speed instruction value for the motor 84 is large, it is apparent from FIG. 3 that the difference between the average value Tb of duty values the average value Tb' of duty values, that is, the change in load torque applied to the motor 84, is large.

In step S14, the CPU 100 reads from the RAM 102 the average values Tb and Tb' of duty values corresponding to PWM signals to be output to the motor 84 with which the speed of the photoconductive drum 1 is equal to the speed instruction value Vd_tar and calculates the difference between the two average values. In step S15, the CPU 100 calculates a speed instruction value Vd for the motor 14 for driving the photoconductive drum 1 with which the difference between the two average values Tb and Tb' calculated in step S14 is substantially zero. When the speed instruction value for the intermediate transfer belt 7 is Vb_tar and the speed instruction value for the photoconductive drum 1 is the calculated speed instruction value Vd, the CPU 100 determines that the surface speeds of the photoconductive drum 1 and the intermediate transfer belt 7 are the same.

Referring to FIG. 3, when the difference between the speed instruction value Vb_tar for the intermediate transfer belt 7 and the speed instruction value Vd_tar for the photoconductive drum 1 is 0%, that is, the speed instruction value Vd_tar is 350 mm/s, the difference between the average values Tb and Tb' (Tb−Tb') is −0.31%. On the other hand, when the difference between the speed instruction value Vb_tar for the intermediate transfer belt 7 and the speed instruction value Vd_tar for the photoconductive drum 1 is +0.1%, the difference between the average values Tb and Tb' is as follows. That is, when the speed instruction value Vd_tar for the photoconductive drum 1 is 350.35 mm/s (=350 mm/s×(100%+0.1%)), the difference between the average values Tb and Tb' (Tb−Tb') is +0.33%. Assuming that average values Tb and Tb' are linearly changed when the difference between the speed instruction value Vb_tar and the speed instruction value Vd_tar is in the range of 0% to +0.1%, a speed instruction value that is a zero cross point of the difference between the average values Tb and Tb' is obtained. The difference between the average values Tb and Tb' is zero when the difference between the speed instruction value Vb_tar and the speed instruction value Vd_tar (Vb_tar−Vd_tar) is +0.048% (=0.31%×0.1/(0.31%+0.33%)). At that time, the speed instruction value Vd for the photoconductive drum 1 is 350.168 mm/s (=350 mm/s×(100%+0.048%)).

The reason why, at the calculated speed instruction value Vd for the photoconductive drum 1, the surface speeds of the photoconductive drum 1 and the intermediate transfer belt 7 are the same is as follows. That is, as described previously, the graph in FIG. 3 indicates that a frictional force is changed in accordance with the presence or absence of the application of a high voltage and a load torque applied to a motor is changed in accordance with the change in the frictional force. Accordingly, the state in which the load torque (duty value) applied to the motor is not changed even though the frictional force is changed can be considered to be the state in which the photoconductive drum 1 and the intermediate transfer belt 7 are not pulled each other at a contact portion of them, that is, the speeds of them are the same.

Even though there are variations in tolerances of the photoconductive drum 1 and the intermediate transfer belt 7, the speed instruction value Vd for the photoconductive drum 1 with which the surface speeds of the intermediate transfer belt 7 and the photoconductive drum 1 are the same can be determined on the basis of the speed instruction value Vb_tar for the intermediate transfer belt 7 as described previously with reference to FIG. 4. Since a toner image is transferred without being subjected to rubbing when the surface speeds of the photoconductive drum 1 and the intermediate transfer belt 7 are the same, the reproducibility of a thin line is high. The occurrence of a void that is a phenomenon in which a character or a line in the center portion of an image is not transferred and a white spot is formed can be prevented by making a difference between surface speeds. Accordingly, at the time of actual image forming, by correcting the calculated speed instruction value Vd in consideration of a void, variations in tolerances of the photoconductive drum 1 and the intermediate transfer belt 7 due to mass production can be corrected and an image of excellent quality can be formed.

In this embodiment, a load torque is used as a duty value corresponding to a PWM signal for the motor 84. However, for example, the value of a current input into the motor 84 which is roughly proportional to a load torque may be used. In addition, in this embodiment, in order to change a frictional force between the photoconductive drum 1 and the intermediate transfer belt 7, a voltage applied to the primary transfer roller 5 is used. However, an embodiment of the present invention is not limited to this case. For example, an actuator (not illustrated) that is a pressure unit for changing a pressure used to bring the primary transfer roller 5 in contact with the photoconductive drum 1 may be used to change a frictional force between the photoconductive drum 1 and the intermediate transfer belt 7.

In the control sequence in FIG. 4, the difference between the speeds of the photoconductive drum 1 and the intermediate transfer belt 7 is changed in a state where the application of a high voltage is not performed and a frictional force is small, and a load torque (first characteristic) applied to the motor 84 is derived. Subsequently, the difference between the speeds of the photoconductive drum 1 and the intermediate transfer belt 7 is changed in a state where the application of a high voltage is performed and a frictional force is large, and a load torque (second characteristic) applied to the motor 84 is derived. However, for example, in the control sequence in FIG. 4, the load torque applied to the motor 84 in a state where a frictional force is large may be derived first or the load torque applied to the motor 84 may be derived after switching between the presence and absence of a frictional force each time the difference between the speeds of the photoconductive drum 1 and the intermediate transfer belt 7 is changed.

Some image forming apparatuses have a monochrome mode in which only the photoconductive drum 1*d* corresponding to black is driven at the time of black-and-white printing to extend the life of image forming stations corresponding to yellow, magenta, and cyan. In this monochrome mode, the primary transfer rollers 5*a*, 5*b*, and 5*c* corresponding to yellow, magenta, and cyan are separated from the photoconductive drums 1*a*, 1*b*, and 1*c*, respectively, and only the primary transfer roller 5*d* corresponding to black is in contact with the photoconductive drum 1*d*. The stretched condition of the intermediate transfer belt 7 is therefore changed and the condition of the contact of the primary transfer unit is changed. In this case, the speed instruction value Vd may be calculated through the control sequence in FIG. 4 in a state where only the photoconductive drum 1 corresponding to black is in contact with the intermediate transfer belt 7.

Thus, according to this embodiment, the circumferential speed difference between the surface speeds of a photoconductive drum and an intermediate transfer belt can be accurately detected and image quality can be improved.

Second Embodiment

In the first embodiment, the speed instruction value Vd_tar set for each of the four photoconductive drums 1*a* to 1*d* is increased by +0.1% and the load torques Tb and Tb' of the intermediate transfer belt 7 at the speed instruction value Vd_tar are calculated. The photoconductive drums 1*a* to 1*d* have different drum diameter tolerances. Therefore, the motors 14*a* to 14*d* for driving the photoconductive drums 1*a* to 1*d*, respectively are driven in accordance with the same speed instruction value Vd_tar, the surface speeds of the photoconductive drums 1*a* to 1*d* are different. In the second embodiment, an exemplary case in which load torques Tda to Tdd of the motors 14*a* to 14*d* for driving the photoconductive drums 1*a* to 1*d*, respectively, are calculated and speed instruction values Vda to Vdd with which the surface speeds of the photoconductive drums 1*a* to 1*d* are equal to the surface speed of the intermediate transfer belt 7 are calculated will be described.

The configurations of an image forming apparatus, a driving unit for the photoconductive drum 1, a driving unit for the intermediate transfer belt 7, and a primary transfer unit according to this embodiment are the same as those described in the first embodiment. In this embodiment, the same reference numerals are used to identify parts already described in the first embodiment, and the description thereof will be therefore omitted.

<Control Sequence for Calculation of Surface Speeds of Photoconductive Drum and Intermediate Transfer Belt>

Figure 5:
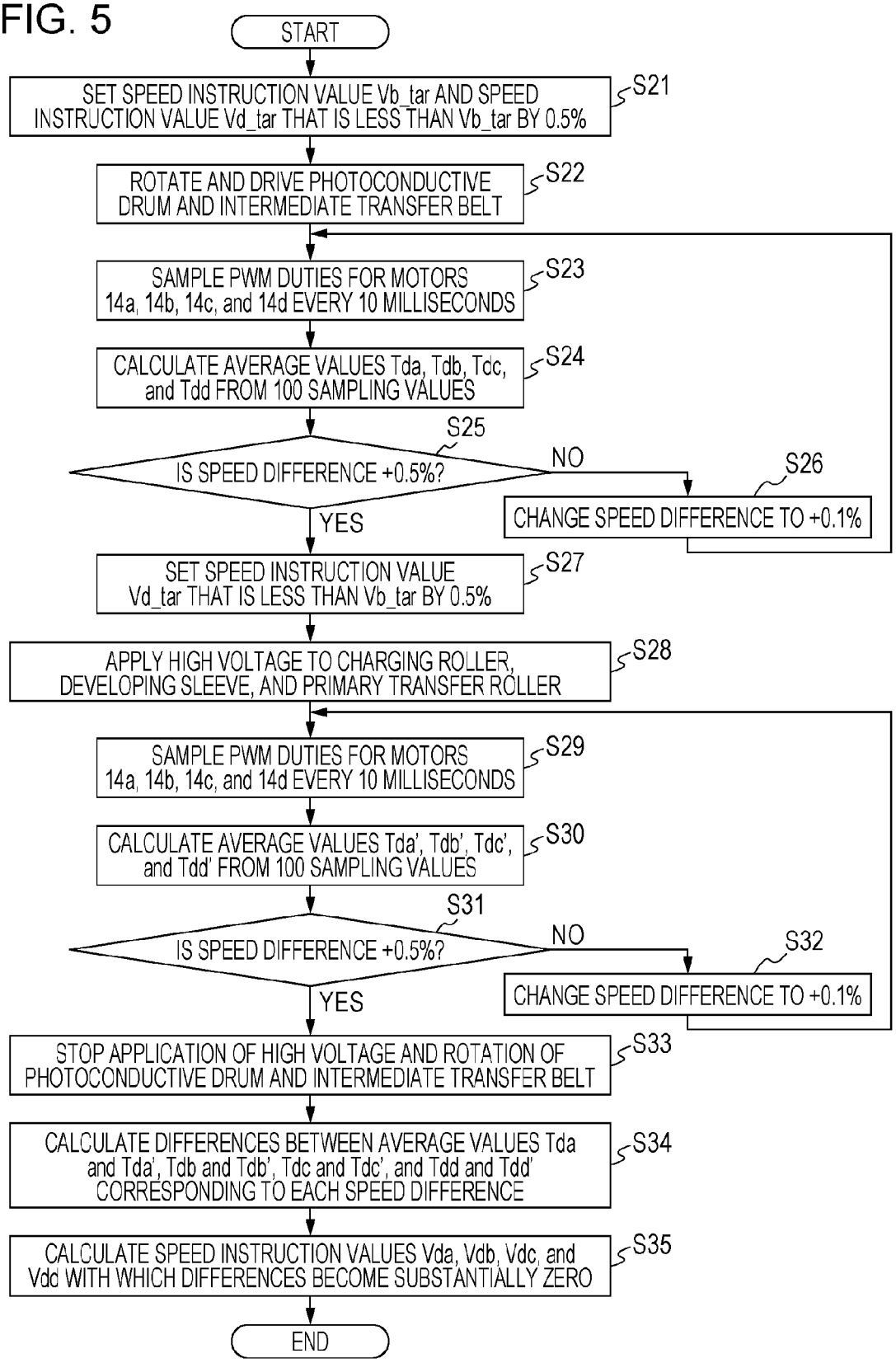
FIG. 5 is a flowchart illustrating a process of calculating a speed instruction value for a photoconductive drum according to the second embodiment.

FIG. 5 is a flowchart illustrating a control sequence for the calculation of a speed instruction value for the photoconductive drum 1 with which the surface speeds of the photoconductive drum 1 and the intermediate transfer belt 7 in an image forming apparatus are the same. The flowchart in FIG. 5 shows an operational sequence in an adjustment mode in which the speeds of the photoconductive drum 1 and the intermediate transfer belt 7 according to this embodiment are adjusted. The adjustment mode illustrated in FIG. 5 is started when the replacement of the photoconductive drum 1 or the intermediate transfer belt 7 is detected or when a maintenance staff for the image forming apparatus makes an adjustment instruction, and is executed by the CPU 100. Like the control sequence according to the first embodiment illustrated in FIG. 4, the control sequence illustrated in FIG. 5 is started when the operational mode is the color mode. For the motors 14 corresponding to the photoconductive drums 1 in all image forming stations, a control process is performed at the same time. That is, the CPU 100 performs the control process so that the speeds of the motors 14*a*, 14*b*, 14*c*, and 14*d* in the image forming stations are the same.

The process from steps S21 to S22 is the same as the process from steps S1 to S2 according to the first embodiment in FIG. 4 which has been described in detail previously, and the description thereof will be therefore omitted. In step S23, the CPU 100 starts a timer after resetting the timer, reads a timer value, and performs the following processing every 10 milliseconds (ms). That is, the CPU 100 acquires duty values corresponding to PWM signals to be output to the motors 14*a*, 14*b*, 14*c*, and 14*d* for driving the photoconductive drums 1*a*, 1*b*, 1*c*, and 1*d*, respectively at the speed instruction value Vd_tar set in step S21 or step S26 to be described later. Referring to FIG. 5, a duty value corresponding to a PWM signal is represented as a PWM duty. A sampling value may be stored in the RAM 102 at the time of the acquisition of the sampling value. Alternatively, acquired sampling values may be added and a sum of them may be stored in the CPU 100. The storage of the acquired sampling value is performed for each of the motors 14*a* to 14*d*. In step S24, the CPU 100 calculates, for the motors 14*a*, 14*b*, 14*c*, and 14*d*, average values Tda, Tdb, Tdc, and Tdd (third load torque) of duty values corresponding to PWM signals acquired in 100 sampling operations per second, respectively. The CPU 100 associates the average values Tda, Tdb, Tdc, and Tdd with the speed instruction values Vd_tar for the photoconductive drums 1*a*, 1*b*, 1*c*, and 1*d*, respectively, and stores them in the RAM 102. Examples of a method of calculating the average values Tda, Tdb, Tdc, and Tdd of duty values of the motors 14*a*, 14*b*, 14*c*, and 14*d*, respectively include a method of sequentially adding the sampling values acquired in step S23 and dividing a sum of the sampling values by 100 at the time of acquisition of 100 sampling values. In steps S23 and S24, the charging roller 2, the developing sleeve 41, and the primary transfer roller 5 in each image forming station are in a state where a high voltage is not applied to them, and the exposure of the exposure device 3 and the rotation and driving of the developing sleeve 41 are stopped.

The process from steps S25 to S28 is the same as the process from steps S5 to S8 according to the first embodiment illustrated in FIG. 4, and the description thereof will be therefore omitted. In step S29 to be described later, processing is performed in a state where the frictional force between the photoconductive drum 1 and the intermediate transfer belt 7 is large. The CPU 100 therefore performs control processing so that a high voltage is applied to the charging roller 2, the developing sleeve 41, and the primary transfer roller 5 in each image forming station. In the control sequence illustrated in FIG. 5, the exposure device 3 does not perform the formation of an electrostatic latent image and toner development. Accordingly, the developing sleeve 41 is not rotated and driven.

In step S29, like in step S23, the CPU 100 starts a timer after resetting the timer and reads a timer value. Every 10 milliseconds (ms), the CPU 100 acquires duty values corresponding to PWM signals to be output to the motors 14*a*, 14*b*, 14*c*, and 14*d* for driving the photoconductive drum 1*a*, 1*b*, 1*c*, and 1*d*, respectively at the speed instruction value Vd_tar set in step S27 or S32 to be described later. In step S30, the CPU 100 calculates average values Tda', Tdb', Tdc', and Tdd' (fourth load torque) of duty values corresponding to PWM signals of the motors 14*a*, 14*b*, 14*c*, and 14*d*, respectively, acquired in 100 sampling operations per second, associates the average values Tda', Tdb', Tdc', and Tdd' with the speed instruction values Vd_tar for the photoconductive drums 1*a*, 1*b*, 1*c*, and 1*d*, respectively, and stores them in the RAM 102. The process from steps S31 to S33 is the same as the process from steps S11 to S13 according to the first embodiment illustrated in FIG. 4, and the description thereof will be therefore omitted.

In step S34, the CPU 100 reads from the RAM 102 the average values Tda, Tdb, Tdc, and Tdd and the average values Tda', Tdb', Tdc', and Tdd' of duty values of the motors 14*a*, 14*b*, 14*c*, and 14*d* at the speed instruction values Vd_tar for the photoconductive drums 1*a*, 1*b*, 1*c*, and 1*d*, respectively, and calculates the differences between the two corresponding average values, Tda and Tda', Tdb and Tdb', Tdc and Tdc', and Tdd and Tdd'. In step S35, the CPU 100 calculates speed instruction values Vda, Vdb, Vdc, and Vdd for the motors 14*a*, 14*b*, 14*c*, and 14*d*, respectively with which the differences between the two corresponding average values calculated in step S34 are substantially zero. A method of calculating these speed instruction values with which the differences between the two corresponding average values are substantially zero has already been described in detail in the first embodiment, and the description thereof will be omitted. When the speed instruction value for the intermediate transfer belt 7 is Vb_tar and the speed instruction values for the photoconductive drums 1*a*, 1*b*, 1*c*, and 1*d* are the speed instruction values Vda, Vdb, Vdc, and Vdd, respectively, the CPU 100 determines that the surface speeds of the photoconductive drums 1*a*, 1*b*, 1*c*, and 1*d* and the intermediate transfer belt 7 are the same.

Even though there are variations in tolerances of the photoconductive drums 1*a* to 1*d* and the intermediate transfer belt 7, the speed instruction values Vda, Vdb, Vdc, and Vdd for the photoconductive drums 1*a*, 1*b*, 1*c*, and 1*d* with which the surface speeds of the intermediate transfer belt 7 and the photoconductive drums 1*a* to 1*d* are the same can be determined on the basis of the speed instruction value Vb_tar through the control sequence in FIG. 5. At the time of actual image forming, by correcting the calculated speed instruction values Vda, Vdb, Vdc, and Vdd in consideration of a void, variations in tolerances of the photoconductive drums 1 and the intermediate transfer belt 7 due to mass production can be corrected and an image of excellent quality can be formed. In this embodiment, the control sequence in which all of the speed instruction values for the four photoconductive drums 1*a*, 1*b*, 1*c*, and 1*d* are changed has been described. However, the speed instruction values for three photoconductive drums 1 (for example, the photoconductive drums 1*b* to 1*d*) may be fixed and only the speed instruction value for one photoconductive drum 1 (for example, the photoconductive drum 1*a*) may be changed. The load torque of the motor 14 (for example, the motor 14*a*) for driving the photoconductive drum 1 may be detected. On the basis of the detected load torque, the surface speed of the photoconductive drum 1 may be calculated. This processing may be performed upon each photoconductive drum. In this embodiment, a load torque is used as a duty value corresponding to a PWM signal for the motor 14. However, for example, the value of a current input into the motor 14 which is roughly proportional to the load torque may be used.

Thus, according to this embodiment, the circumferential speed difference between the surface speeds of a photoconductive drum and an intermediate transfer belt can be accurately detected and image quality can be improved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-121495, filed Jun. 12, 2014, which is hereby incorporated by reference herein in its entirety.

What is claimed is:

1. An image forming apparatus comprising:

an image bearing member configured to carry a toner image;

a belt member which is in contact with the image bearing member, wherein the toner image from the image bearing member is transferred to the belt member;

a first driving source configured to drive the image bearing member;

a first detection member configured to detect a rotation speed of the image bearing member;

a rotary member configured to apply a driving force to the belt member;

a second driving source configured to drive the rotary member;

a second detection member configured to detect a rotation speed of the rotary member;

a transfer member that is in contact with the image bearing member across the belt member;

a power supply configured to apply a voltage to the transfer member;

a control unit configured to control the first driving source on the basis of a detection result of the first detection member and control the second driving source on the basis of a detection result of the second detection member;

a switching unit configured to switch between a first state and a second state, no voltage being applied from the power supply to the transfer member in the first state, a voltage being applied from the power supply to the transfer member in the second state;

an acquisition unit configured to acquire information on a load torque applied to the second driving source when the second driving source drives the rotary member at a predetermined rotation speed; and an execution unit configured to execute an image formation with a rotation speed of the image bearing member based on a first relationship and a second relationship, the first relationship being a relationship between each of a plurality of different rotation speeds with which the image bearing member is driven in the first state and the corresponding information acquired by the acquisition unit, and the second relationship being a relationship between each of a plurality of different rotation speeds with which the image bearing member is driven in the second state and the corresponding information acquired by the acquisition unit.

2. The image forming apparatus according to claim 1, wherein the information on a load torque applied to the second driving source is a duty value of a signal input into the second driving source when the rotary member is controlled at a predetermined rotation speed.

3. The image forming apparatus according to claim 1, wherein the information on a load torque applied to the second driving source is a current value of a signal input into the second driving source when the rotary member is controlled at a predetermined rotation speed.

4. The image forming apparatus according to claim 1, wherein the execution unit executes the image formation with the rotation speed of the image bearing member based on a rotation speed of the image bearing member with which a difference between the first relationship and the second relationship becomes zero.

5. The image forming apparatus according to claim 1, further comprising a plurality of the image bearing members, wherein the execution unit executes the image formation with rotation speeds of the plurality of image bearing members in a state where the plurality of image bearing members are in contact with the belt member.

6. The image forming apparatus according to claim 1, wherein the image bearing member includes a first image bearing member configured to carry a color toner image and a second image bearing member configured to carry a black toner image, and wherein the execution unit executes the image formation with a rotation speed of the second image bearing member in a state where the second image bearing member is in contact with the belt member.

7. An image forming apparatus comprising:

an image bearing member configured to carry a toner image;

a belt member which is in contact with the image bearing member, wherein the toner image from the image bearing member is transferred to the belt member;

a first driving source configured to drive the image bearing member;

a first detection member configured to detect a rotation speed of the image bearing member;

a rotary member configured to apply a driving force to the belt member;

a second driving source configured to drive the rotary member;

a second detection member configured to detect a rotation speed of the rotary member;

a transfer member that is in contact with the image bearing member across the belt member;

a power supply configured to apply a voltage to the transfer member;

a control unit configured to control the first driving source on the basis of a detection result of the first detection member and control the second driving source on the basis of a detection result of the second detection member;

a switching unit configured to switch between a first state and a second state, no voltage being applied from the power supply to the transfer member in the first state, a voltage being applied from the power supply to the transfer member in the second state;

an acquisition unit configured to acquire information on a load torque applied to the first driving source when the first driving source drives the image bearing member at a predetermined rotation speed; and an execution unit configured to execute an image formation with a rotation speed of the rotary member based on a first relationship and a second relationship, the first relationship being a relationship between each of a plurality of different rotation speeds with which the rotary member is driven in the first state and the corresponding information acquired by the acquisition unit, and the second relationship being a relationship between each of a plurality of different rotation speeds with which the rotary member is driven in the second state and the corresponding information acquired by the acquisition unit.

8. The image forming apparatus according to claim 7, wherein the information on a load torque applied to the first driving source is a duty value of a signal input into the first driving source when the image bearing member is controlled at a predetermined rotation speed.

9. The image forming apparatus according to claim 7, wherein the information on a load torque applied to the first driving source is a current value of a signal input into the first driving source when the image bearing member is controlled at a predetermined rotation speed.

10. The image forming apparatus according to claim 7, wherein the execution unit executes the image formation with the rotation speed of the rotary member based on a rotation speed of the rotary member with which a difference between the first relationship and the second relationship becomes zero.

11. The image forming apparatus according to claim 7, further comprising a plurality of the image bearing members, wherein the execution unit executes the image formation with the rotation speed of the rotary member in a state where the plurality of image bearing members are in contact with the belt member.

12. The image forming apparatus according to claim 7, wherein the image bearing member includes a first image bearing member configured to carry a color toner image and a second image bearing member configured to carry a black toner image, and wherein the execution unit executes the image formation with the rotation speed of the rotary member in a state where the second image bearing member is in contact with the belt member.

* * * * *